US007297857B2

(12) United States Patent
Nishitani et al.

(10) Patent No.: US 7,297,857 B2
(45) Date of Patent: Nov. 20, 2007

(54) SYSTEM OF PROCESSING MUSIC PERFORMANCE FOR PERSONALIZED MANAGEMENT AND EVALUATION OF SAMPLED DATA

(75) Inventors: Yoshiki Nishitani, Hamakita (JP); Kenji Ishida, Hamamatsu (JP); Eiko Kobayashi, Hamakita (JP)

(73) Assignee: Yamaha Corporation, Shizuoka-Ken (JP)

( * ) Notice: Subject to any disclaimer, the term of this patent is extended or adjusted under 35 U.S.C. 154(b) by 127 days.

(21) Appl. No.: 10/640,590

(22) Filed: Aug. 13, 2003

(65) Prior Publication Data

US 2004/0055443 A1 Mar. 25, 2004

(51) Int. Cl.
*G10H 1/00* (2006.01)

(52) U.S. Cl. ..... 84/600; 340/573.1

(58) Field of Classification Search ..... 84/600, 84/601, 609, 615; 482/8; 340/573.1
See application file for complete search history.

(56) References Cited

U.S. PATENT DOCUMENTS

| | | | | |
|---|---|---|---|---|
| 5,177,311 | A | 1/1993 | Suzuki et al. | 84/600 |
| 6,132,337 | A * | 10/2000 | Krupka et al. | 482/8 |
| 6,662,032 | B1 * | 12/2003 | Gavish et al. | 600/323 |
| 6,703,549 | B1 * | 3/2004 | Nishimoto et al. | 84/609 |
| 6,856,249 | B2 * | 2/2005 | Strubbe et al. | 340/573.1 |
| 2001/0015123 | A1 | 8/2001 | Nishitani et al. | 84/615 |
| 2003/0070537 | A1 | 4/2003 | Nishitani et al. | 84/633 |
| 2004/0020348 | A1 * | 2/2004 | Ishida et al. | 84/609 |
| 2004/0171460 | A1 * | 9/2004 | Park | 482/8 |

FOREIGN PATENT DOCUMENTS

| | | |
|---|---|---|
| GB | 2377315 A | 1/2003 |
| JP | 09-237088 | 9/1997 |
| JP | 2001-067572 | 3/2001 |
| JP | 2001-340319 | 12/2001 |

* cited by examiner

*Primary Examiner*—Lincoln Donovan
*Assistant Examiner*—Jianchun Qin
(74) *Attorney, Agent, or Firm*—Harness, Dickey & Pierce, PLC

(57) ABSTRACT

A performance processing apparatus is operable by user with aide of control and sound devices for providing sample music data to data management apparatus. A storage section stores original music data representing a music piece composed of tones. An acquisition section acquires input information from control device which has a detector for detecting either physical action or physiological state of user and operated by user to provide input information indicating detection result by detector. A processing section controls a performance parameter according to input information for enabling sound device to generate tones of the music piece represented by original music data and altered by user. A transmitting section transmits sample music data representing music piece composed of tones controlled by the performance parameter to the data management apparatus which has a storage device for storing sample music data for use as a material of evaluating mental or physical function of user.

19 Claims, 11 Drawing Sheets

FIG.7

PERFORMANCE CONTENTS TABLE

| GROUP | MUSIC | USER | PART |
|---|---|---|---|
| GROUP Ga | MUSIC A | USER Ua1 | PART#1 |
| | | USER Ua2 | PART#3 |
| | | USER Ua3 | PART#2,#4 |
| | | ⋮ | ⋮ |
| GROUP Gb | MUSIC B | USER Ub1 | PART#2 |
| | | USER Ub2 | PART#5 |
| | | USER Ub3 | PART#1,#3 |
| | | ⋮ | ⋮ |
| ⋮ | ⋮ | ⋮ | ⋮ |

SYSTEM OF PROCESSING MUSIC PERFORMANCE FOR PERSONALIZED MANAGEMENT AND EVALUATION OF SAMPLED DATA

BACKGROUND OF THE INVENTION

1. Industrial Field of Utilization

The present invention relates generally to a technology for controlling tones sounded from a sound output device such as a loudspeaker in accordance with operations by a user or physiological conditions of a user.

2. Prior Art

Music therapy has been attracting attention in wide-ranging medical care fields such as the rehabilitation for maintaining and recovering mental and physical functions, the treatment of diseases, the prevention of dementia, and the caring of handicapped children. In music therapy, methods are employed in which music is used to mitigate the anxiety and pain of patients and the behavior in music performance by patients is observed by experts called music therapists to evaluate (or diagnose) patient's mental and physical functions.

However, in music therapy, the mental and physical functions of patients are evaluated in accordance with the results of observation of the patient's behavior in music performance. In contrast to the conventional medical approaches based on the evaluation of patient's mental and physical functions by use of quantitative data such as heart rate and blood pressure, the music therapy is difficult to objectively grasp patient's mental and physical functions.

SUMMARY OF THE INVENTION

It is therefore an object of the present invention to collect the quantitative data to be provided for the evaluation of user's mental and physical functions and TO use the collected data for the evaluation of user's mental and physical functions.

In carrying out the invention and according to one aspect thereof, there is provided a performance processing apparatus operable by a user with an aide of a control device and a sound device for providing sample music data to a data management apparatus. The inventive performance processing apparatus comprises a first storage section that stores original music data representing a music piece composed of tones, an acquisition section that acquires input information from the control device which has a detector for detecting either of physical action or physiological state of the user and which is operated by the user to provide the input information indicating the detection result by the detector, a processing section that controls a performance parameter according to the input information for enabling the sound device to generate tones of the music piece which is represented by the original music data and which is altered by the user, and a transmitting section that transmits sample music data representing the music piece composed of the tones controlled by the performance parameter to the data management apparatus which has a second storage section for storing the sample music data for use as a material of evaluating mental or physical function of the user.

According to this novel configuration, the sample music data with the performance parameters of the original music data controlled in accordance with user's action or physiological condition are generated, so that the sample music data may be used as the quantitative data for evaluating user's mental and physical functions.

In another aspect of the invention, the above-mentioned data management apparatus is provided for managing data including original music data and sample music data in association with a performance processing apparatus having a sound device and being operated by a user. The inventive data management apparatus comprises a receiving section that receives the sample music data from the performance processing apparatus, which controls a performance parameter according to input information representing physical action or physiological state of the user for enabling the sound device to generate tones of a music piece which is represented by the original music data and which is altered by the user, and which transmits the sample music data representing the music piece composed of the tones controlled by the performance parameter, and a storage section that stores the received sample music data for use as a material of evaluating mental or physical function of the user.

According to this data management apparatus, the sample music data with user's action or physiological condition reflected are held in its storage section, so that use of these sample music data may realize the objective evaluation of user's mental and physical functions.

In the above-mentioned data management apparatus, the sample music data stored in the storage section may be transmitted to the evaluation apparatus which is separate from the data management apparatus. Otherwise, the data management apparatus may have a providing section for providing the sample music data to the evaluator who evaluates user's mental and physical functions on the basis of the performance parameters of the sample music data. Namely, the data management apparatus associated with the former has a sample music data transmitting section for transmitting the sample music data stored in the above-mentioned sample music data storage section to the evaluation apparatus for evaluating the mental and physical functions of the user of the above-mentioned performance processing apparatus on the basis of the performance parameters of the sample music data. On the other hand, the data management apparatus associated with the latter has a data providing section for providing the data to the evaluator who evaluates the mental and physical functions of the user of the above-mentioned performance processing apparatus on the basis of the performance parameters of the sample music data. In each configuration, in order to realize a more objective and reliable evaluation, it is desirable to arrange a configuration in which not only the sample music data but also the original music data common in music with the sample music data, thereby providing these two data for the evaluation of user's mental and physical functions on the basis of the comparison between the performance parameters of the sample music data and those of the original music data.

In carrying out the invention and according to still another aspect thereof, there is provided an evaluation apparatus in association with the data management apparatus for evaluating sample music data from the performance processing apparatus having a sound device and being operated by a user. The inventive evaluation apparatus comprises a receiving section that receives the sample music data via the data management apparatus from the performance processing apparatus, which controls a performance parameter according to input information representing physical action or physiological state of the user for enabling the sound device to generate tones of a music piece which is represented by original music data and which is altered by the user, and which transmits the sample music data representing the music piece composed of the tones controlled by the performance parameter, a storage section that stores the sample music data received by the receiving section, and a providing section that provides the sample music data to an evaluator who evaluates a mental or physical function of the user according to the performance parameter contained in the provided sample music data.

According to this evaluation apparatus, the evaluator may objectively evaluate user's mental and physical functions on the basis of the performance parameters of the sample music data supplied from the data providing section. It should be noted that, in order to realize a more objective and reliable evaluation, it is desirable to provide, in addition to the sample music data, the original music data to the evaluator who evaluate user's mental and physical functions on the basis of the comparison between the performance parameters of the sample music data and those of the original music data.

It should be noted that the present invention may also be identified as a data management system comprising the above-mentioned performance processing apparatus, data management apparatus, and evaluation apparatus. In this data management system, the data management apparatus and the evaluation apparatus may be arranged in one unit or separate units. In addition, the present invention may be identified as a software program for making a computer function as the above-mentioned performance processing apparatus, data management apparatus, or evaluation apparatus. This software program may be installed in the computer via a network or from a computer-readable recording medium.

BRIEF DESCRIPTION OF THE DRAWINGS

FIG. 7 is a diagram illustrating the contents of a performance contents table.

DETAILED DESCRIPTION OF THE INVENTION

Figure 1:
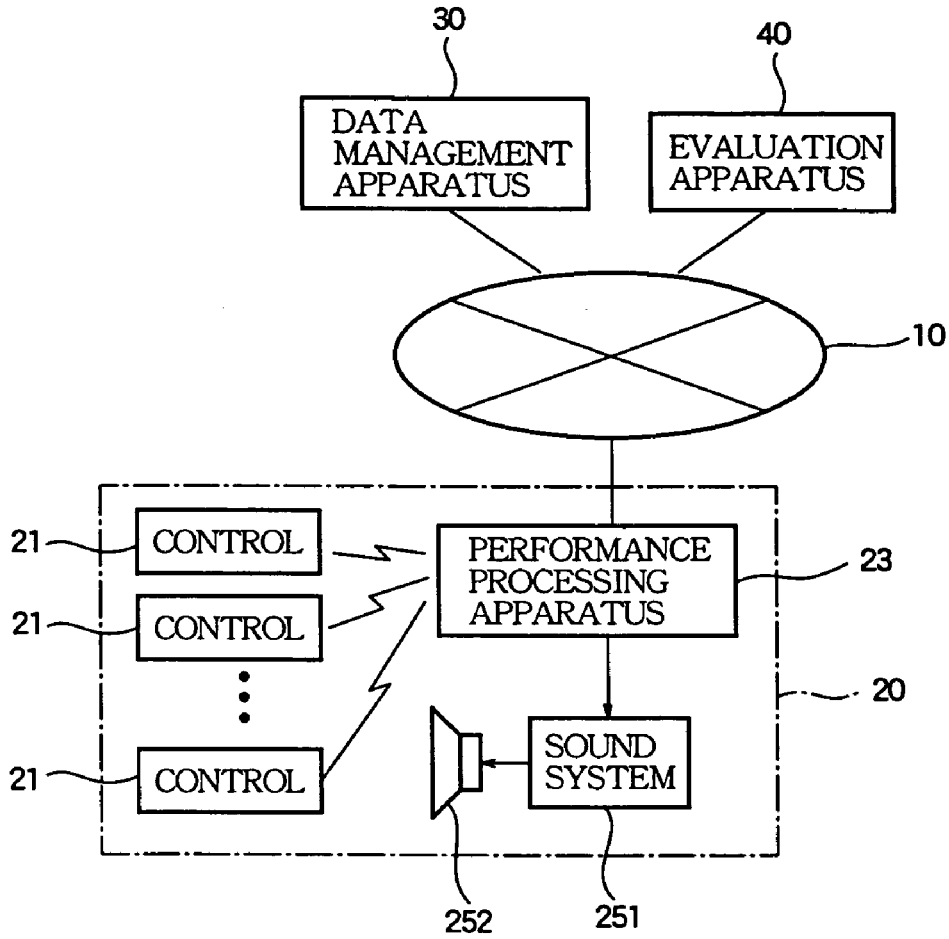
FIG. 1 is a block diagram illustrating a configuration of a communication system practiced as one embodiment of the invention.

This invention will be described in further detail by way of example with reference to the accompanying drawings.

<A: Configuration of Embodiment>

First, an entire configuration of a communication system practiced as one embodiment of the invention will be described with reference to FIG. 1. As shown in the figure, this communication system comprises a communication network 10 including the Internet, a public telephone network, and so on, a performance processing system 20, a data management apparatus 30, and an evaluation apparatus 40. The data management apparatus 30, the evaluation apparatus 40, and a performance processing apparatus 23 of the performance processing system 20 are connected to the communication network 10. It should be noted that FIG. 1 illustrates a configuration in which the performance processing apparatus 23 (the performance processing system 20), the data management apparatus 30, and the evaluation apparatus 40 are arranged each in a single unit; it will be apparent that each of the these apparatuses may be arranged in two or more units.

The performance processing system 20 is installed at facilities (for example, rehabilitation facilities and nursing homes) for those having mental or physical troubles and patients suffering from various diseases (these people will hereafter be referred to as "users"). This performance processing system 20, while controlling the performance parameters (tempo, volume, and so on) of a tone sounded from a loudspeaker on the basis of music data in accordance with the action of the user, generates new music data (namely, the music data of tones actually sounded from the loudspeaker) with the performance parameters changed in accordance with this action of the user. In what follows, the music data on which the sound output by the performance processing system 20 is based may be referred to as "original tone data" to distinguish from the new music data to be referred to as "sample music data" generated on the basis of this sound output. Obviously, if these two kinds of tone data need not be distinguished from each other, they will be generically referred to as "tone data." As described above, the sample music data are obtained by reflecting the action of the user. Therefore, in the present embodiment, the sample music data generated by the performance processing system 20 are put in use as the data for evaluating the mental and physical functions of the user.

As shown in FIG. 1, the performance processing system 20 comprises a plurality of controls 21, the performance processing apparatus 23, a sound system 251, and a loudspeaker 252. The sound system 251 and the loudspeaker 252 output tones under the control of the performance processing apparatus 23. To be more specific, the sound system 251 receives the digital data (hereafter referred to as tone waveform data) indicative of the waveform of tones from the performance processing apparatus 23, converts the received tone waveform data into an analog signal, amplifies this analog signal, and outputs the amplified analog signal. The loudspeaker 252 outputs, as music tones, the analog signal received from the sound system 251. Instead of the loudspeaker 252, an earphone or a headphone may be used.

Figure 2:
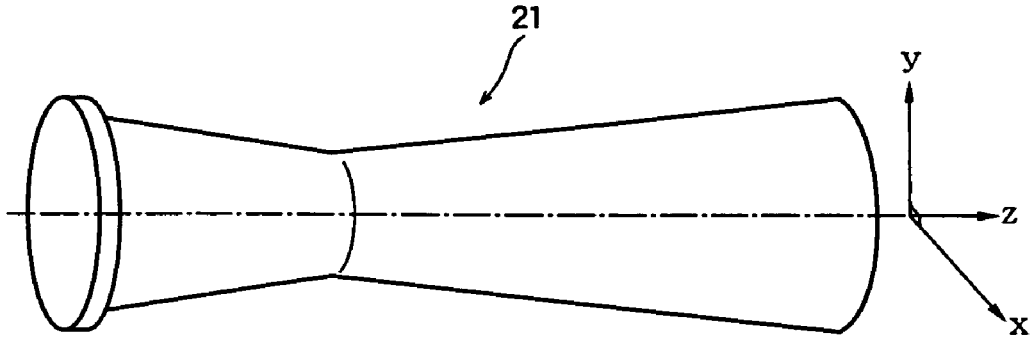
FIG. 2 is a perspective view illustrating the external view of a control.

Each of the plurality of controls 21 is carried or worn by the user to detect the action of the user and transmits the information indicative of the detection results (hereafter referred to as "action information") to the performance processing apparatus 23. As shown in FIG. 2, the control 21 associated with the invention is a long, generally cylindrical member which is gripped by the user. To be more specific, the control 21 is tapered from its each end toward a position in the proximity of the center along its length so that this position is smaller in diameter than each end. Gripping the control 21 on the position in the proximity of the center of the control 21, the user swings or shakes the control 21 as desired. In what follows, with the user, standing perpendicular to the horizontal plane, gripping the control 21, its length being toward the user, the horizontal direction relative to the user is expressed as "x-axis direction," the vertical (up and down) direction relative the user is expressed as "y-axis direction," and the forward and backward direction relative to the user is expressed as "z-axis direction."

Figure 3:
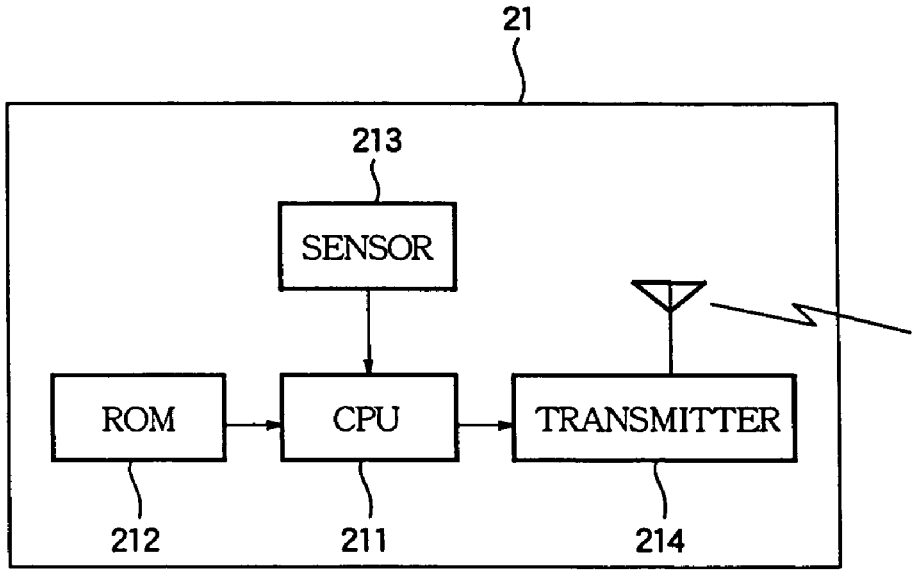
FIG. 3 is a block diagram illustrating an internal configuration of the above-mentioned control.

Referring to FIG. 3, there is shown a block diagram illustrating an internal configuration of the control 21. As shown, the control 21 comprises a CPU (Central Processing Unit) 211, a ROM (Read Only Memory) 212, a sensor 213, and a transmitter 214. The CPU 211 controls the entire operation of the control 21 by executing programs stored in the ROM 212. The ROM 212 stores the programs to be executed by the CPU 211 and the identification information allocated uniquely to the control 21.

The sensor 213 outputs to the CPU 211 an electrical signal corresponding to an action of the user, in other words, an electrical signal corresponding to a motion of the control 21 accompanying an operation of the user. The sensor 213 may be any of detection devices such as two-dimensional velocity sensor, two-dimensional acceleration sensor, three-dimensional velocity sensor, three-dimensional acceleration sensor, and strain detector. In the present embodiment, a three-dimensional acceleration sensor for detecting the accelerations in the x-axis, y-axis, and z-axis directions is assumed as the sensor 213. The CPU 211 generates action information on the basis of the electrical signals supplied from the sensor 213. This action information includes acceleration $\alpha x$ in the x-axis direction, acceleration $\alpha y$ in the y-axis direction, and acceleration $\alpha z$ in the z-axis direction (refer to FIG. 10).

On the other hand, the transmitter 214 executes communication with the performance processing apparatus 23. To be more specific, the transmitter 214 transmits the action information generated by the CPU 211 to the performance processing apparatus 23 along with the identification information of the control 21. For the communication between the transmitter 214 and the performance processing apparatus 23, the infrared communication based on IrDA or the wireless communication based on Bluetooth (trademark) may be used. However, the communication between the transmitter 214 and the performance processing apparatus 23 is not limited to the above-mentioned communication schemes; for example, a communication cable may be connected between the transmitter 214 and the performance processing apparatus 23 for wired communication.

Figure 4:
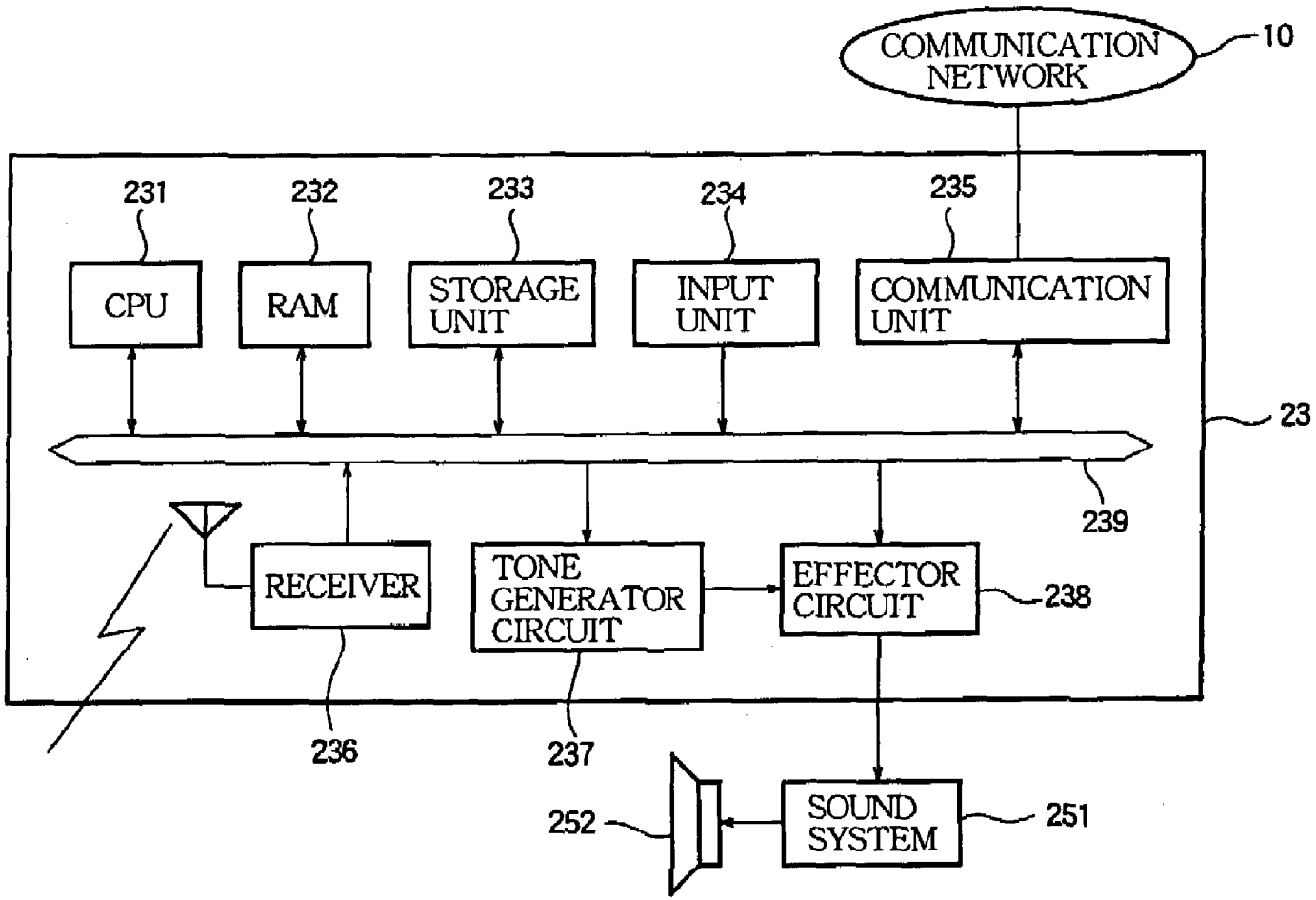
FIG. 4 is a block diagram illustrating a configuration of a performance processing apparatus.

The performance processing apparatus 23 shown in FIG. 1 is a computer system which controls the performance parameters in accordance with an action of the user and outputs the resultant tones indicated by the original music data from the loudspeaker 252 while generating the sample music data indicative of the music based on the tones with the performance parameters controlled and altered. As shown in FIG. 4, the performance processing apparatus 23 comprises a CPU (Central Processing Unit) 231, a RAM (Random Access Memory) 232, a storage unit 233, an input unit 234, a communication unit 235, a receiver 236, a tone generator circuit 237, and an effector circuit 238. These components are interconnected via a bus 239.

The CPU 231 controls the entire operation of the performance processing apparatus 23 by executing the programs stored in the storage unit 233 and a ROM (Read Only Memory) not shown. The RAM 232 is used by the CPU 231 as its main storage. Namely, the RAM 232 temporarily stores the programs to be executed by the CPU 231 and the data for use in the execution of these programs. The storage unit 233 is a hard disk drive for example, which stores the programs to be executed by the CPU 231, for example. These programs include a performance processing program for controlling the performance parameters of music in accordance with the action information inputted from the control 21.

Figure 5:
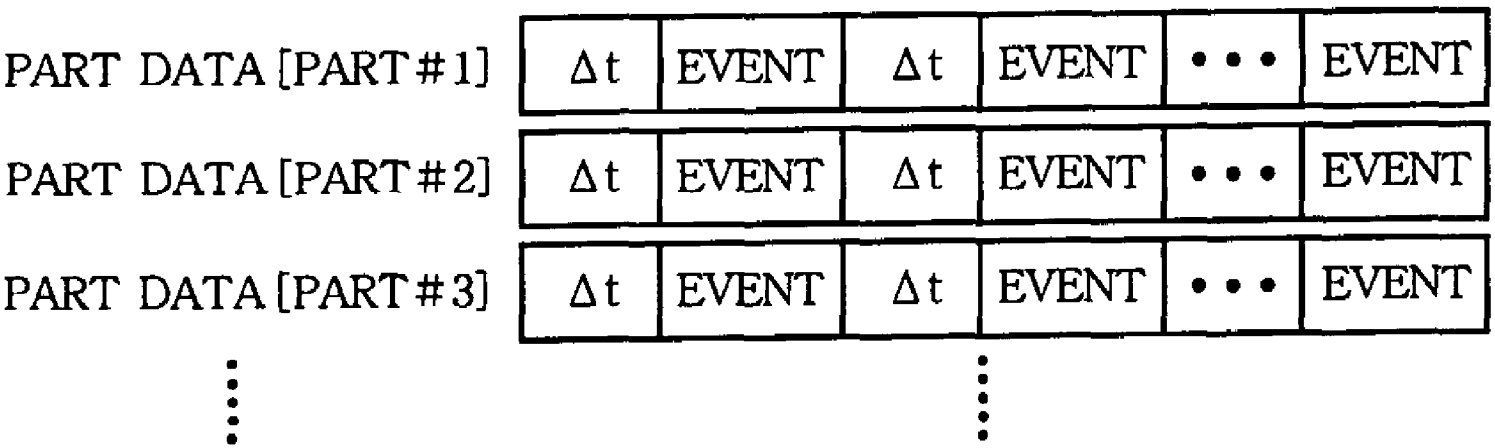
FIG. 5 is a diagram illustrating a configuration of music data.

The storage unit 233 also stores the original music data and the sample music data generated on the basis of the original music data. In the present embodiment, the original music data and the sample music data are both of SMF (Standard MINI File) format based on MIDI (Musical Instrument Digital Interface). Referring to FIG. 5, there is schematically shown a data structure of music data (the original music data and the sample music data). The music data of one piece of music include two or more pieces of data (hereafter referred to as part data) corresponding to different parts. Each piece of part data is a data sequence made up of many sequentially arranged pairs of delta time ($\Delta$ t) and events. The delta time is data indicative of a time interval between two events outputted contiguously in time to the tone generator circuit 237.

The events in the part data specify, for the tone generator circuit 237, the tone of that part and the generation or mute of this tone and are largely divided into MIDI events for specifying the contents of performance such as note-on and note-off and the meta events for specifying tempo and so on. The MIDI events include a note-on event including the specifications of a note number to be sounded and velocity, a note-off event including the specification of a tone to be noted off, a program change event including the specification of timbre, a control change event including the specification of an effect to be imparted to a tone, and a pitch bend event including the specification of a pitch variable. The meta events include the specification of music tempo and so on.

The input unit 234 shown in FIG. 4 has a plurality of operator keys through which the user enters various operations and supplies the electrical signals representative of these operations to the CPU 231. The communication unit 235 exchanges information with the data management apparatus 30 via the communication network 10. To be more specific, the communication unit 235 receives the original music data from the data management apparatus 30 and outputs the received data to the CPU 231, at the same time receiving from the CPU 231 the sample music data generated in accompaniment with the performance processing using the original music data to transmit the received sample music data to the data management apparatus 30. The receiver 236 carries out communication with the controls 21. Namely, the receiver 236 receives action information from one or more of the controls 21 and outputs the received information to the CPU 231.

The tone generator circuit 237 and the effector circuit 238 are means for generating tone waveform data under the control of the CPU 231, each being constituted by a DSP (Digital Signal Processor). The tone generator circuit 237, upon reception of an event from the CPU 231, generates tone waveform data indicative of a tone waveform corresponding to the received event. The tone generator circuit 237 has a plurality of channels corresponding to different parts. In each of the channels, the event of part data corresponds to that channel. In this configuration, the tone waveform data of a plurality of parts are outputted in parallel from the tone generator circuit 237.

The effector circuit 238 imparts various musical effects to the tone waveform data of different parts outputted from the tone generator circuit 237. The contents and degrees of the effects to be imparted by the effector circuit 238 are determined by the CPU 231 with reference to the action information received from the controls 21 corresponding to the parts. The effects to be imparted to tones include reverberation, echo, and others.

Figure 6:
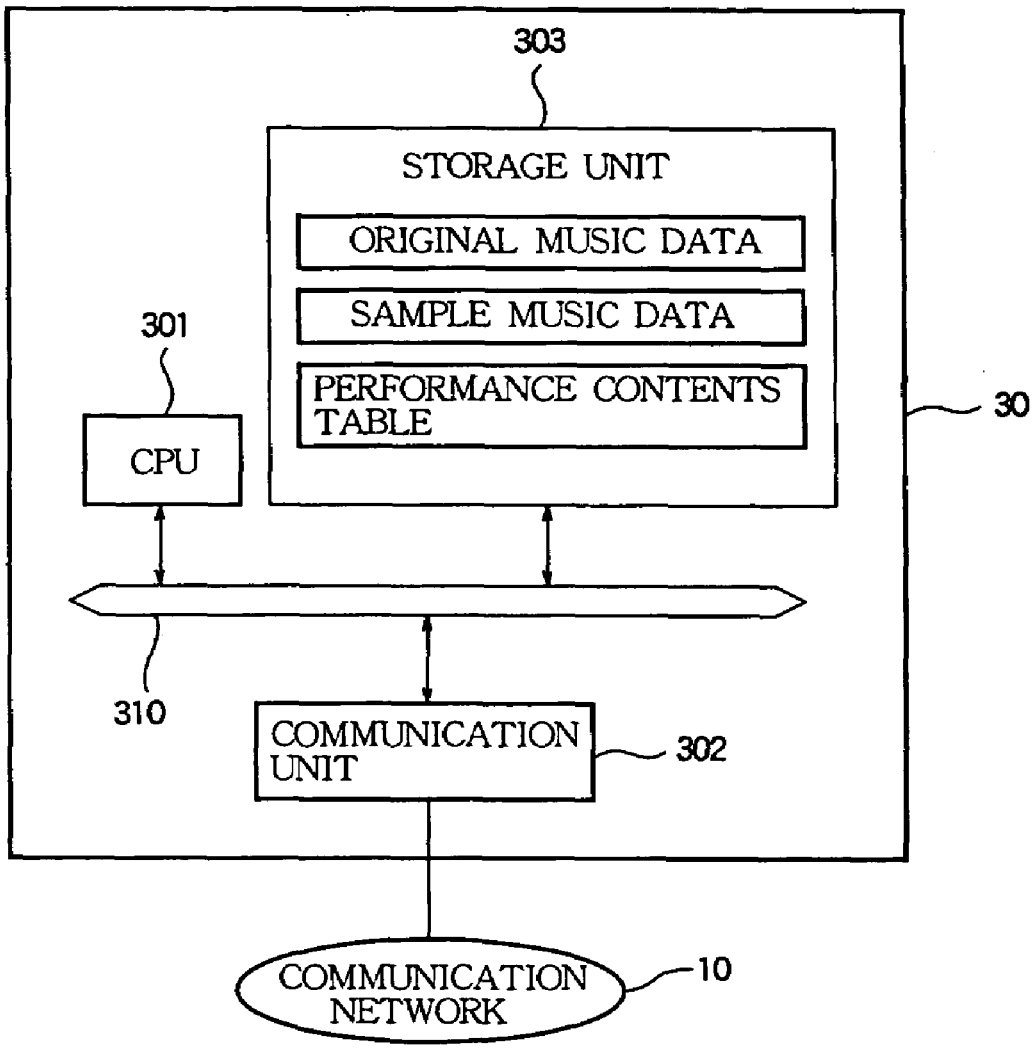
FIG. 6 is a block diagram illustrating a configuration of a data management apparatus.

The data management apparatus 30 shown in FIG. 1 is a computer system for managing the original music data of the music to be performed in the performance processing system 20 and for managing the sample music data created by the performance processing apparatus 23. As shown in FIG. 6, the data management apparatus 30 comprises a CPU (Central Processing Unit) 301, a communication unit 302 connected to the CPU 301 via a bus 310, and a storage unit 303. The CPU 301 controls the components of the data management apparatus 30 by executing programs stored in the storage unit 303. On the other hand, the communication unit 302 carries out communication with the performance processing apparatus 23 and the evaluation apparatus 40 via the communication network 10.

The storage unit 303 stores original music data, sample music data, and a performance contents table, in addition to the data management program to be executed by the CPU 301. The sample music data stored in the storage unit 303 were created in the past by the performance processing apparatus 23 on the basis of the action of the user. Therefore, for each piece of music indicated by the original music data, two or more pieces of sample music data created in the past can be stored in the storage unit 303. It should be noted that the configurations of the original music data and the sample music data are as described with reference to FIG. 5. The performance contents table is indicative of the contents of performance processing conducted in the performance processing system 20. To be more specific, as shown in FIG. 7, the performance contents table has a plurality of records. Each of these records includes, as fields, the names of groups performed by use of the performance processing system 20, one or more user names belonging to that group, and one or more part names allocated to the controls 21 owned by each user.

The evaluation apparatus 40 shown in FIG. 1, is a computer system installed at facilities (such as medical facilities or a nursing home) in which such experts associated with the evaluation and analysis of mental and physical functions as music therapists reside. The evaluation apparatus 40 is used for evaluating the mental and physical functions of the user. In what follows, the person (for example, a music therapist) who evaluates the user's mental and physical functions by use of the evaluation apparatus 40 is referred to simply as "evaluator."

Figure 8:
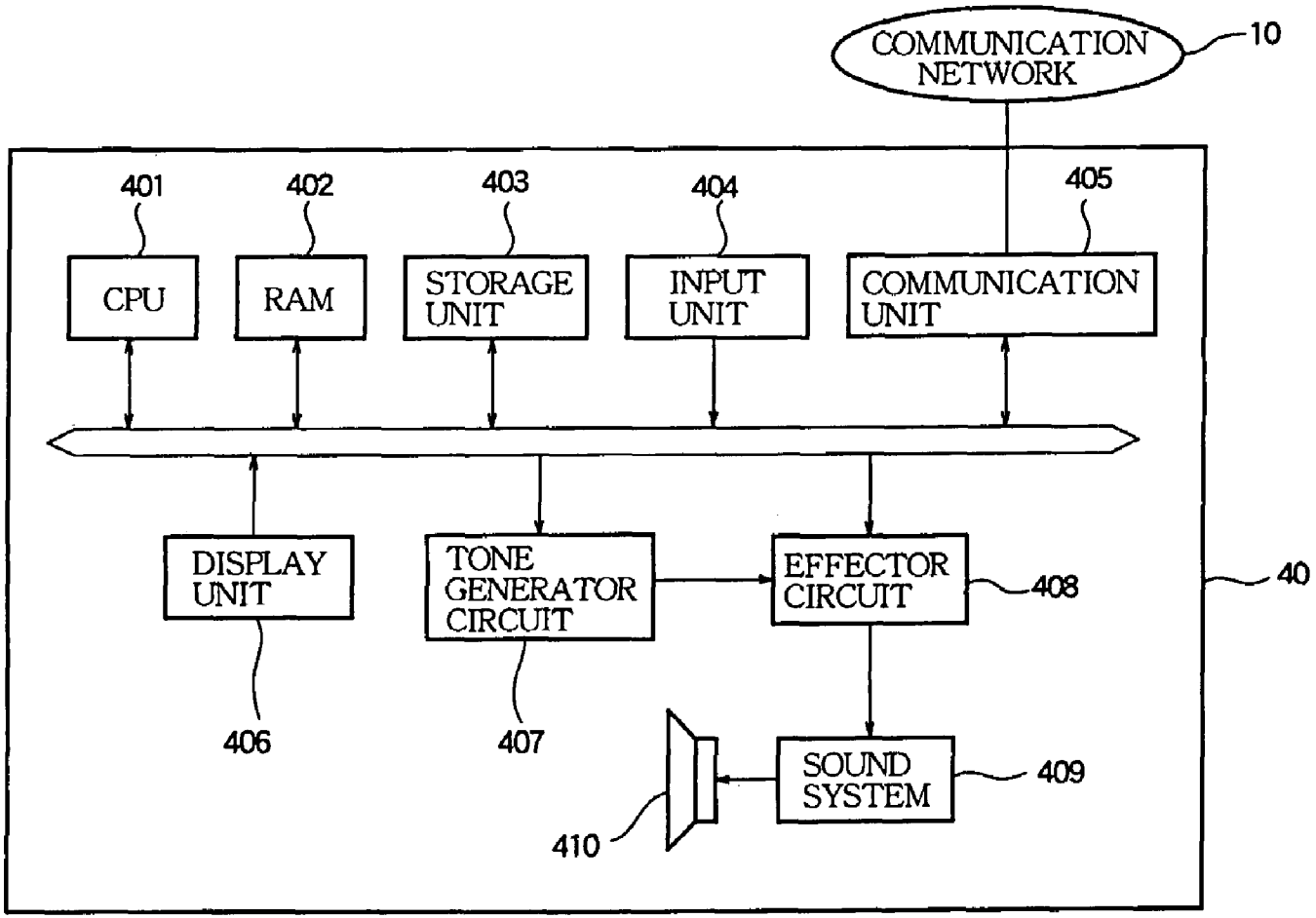
FIG. 8 is a block diagram illustrating a configuration of an evaluation apparatus.

As shown in FIG. 8, the evaluation apparatus 40 comprises a CPU (Central Processing Unit) 401, a RAM (Random Access Memory) 402, a storage unit 403, an input unit 404, a communication unit 405, a display unit 406, a tone generator circuit 407, an effector circuit 408, a sound system 409, and a loudspeaker 410. It should be noted that the CPU 401, the RAM 402, the storage unit 403, the communication unit 404, the tone generator circuit 405, the effector circuit 408, the sound system 409, and the loudspeaker 410 are the same in function as those shown in FIG. 4. Therefore, the descriptions of these components will be skipped herein. However, it should be noted that the storage unit 403 stores the evaluation program to be executed by the CPU 401. This evaluation program provides the evaluator with the performance parameters of the sample music data and the parameters of the original music data as the data for evaluating user's mental and physical functions.

The display unit 406 comprises a CRT (Cathode Ray Tube) and a liquid crystal display panel for example, and displays various images under the control of the CPU 401. To be more specific, the display unit 406 displays in graph the change in performance parameters from the start of a music performance to its end based on the sample music data created for a particular piece of music and the original music data of that piece of music. Visually checking this change, the evaluator executes comparison between the change in the performance parameters of the sample music data and the change in performance parameters of the original music data, thereby evaluating user's mental and physical functions.

<B: Operation of Embodiment>

Figure 9:
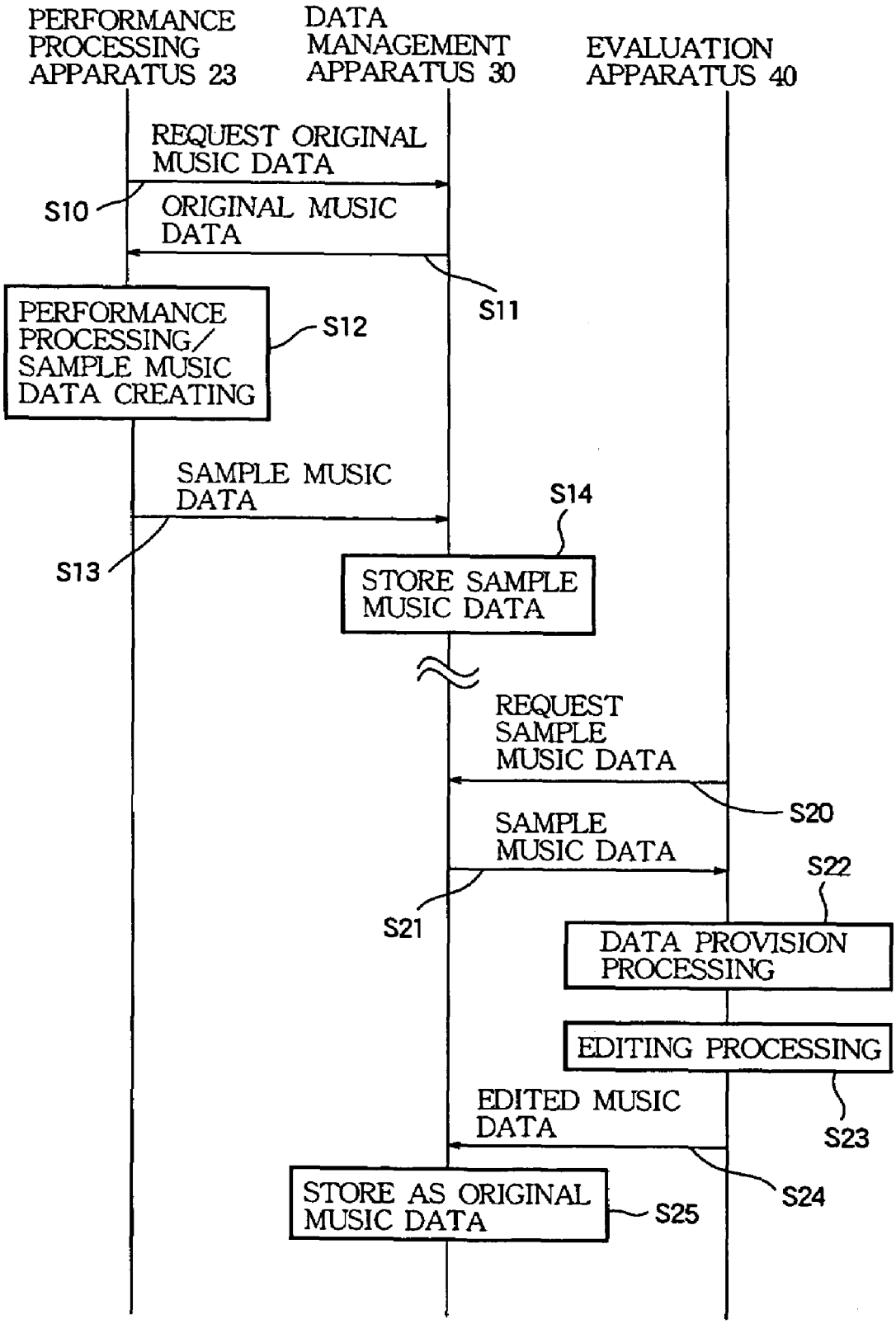
FIG. 9 is a sequence chart illustrating operations of the above-mentioned embodiment.

The following describes the operation of the present embodiment with reference to FIG. 9. In what follows, the operation will be described on focus of the transfer of data between the performance processing apparatus 23 and the data management apparatus 30 and the operation on focus of the transfer of data between the data management apparatus 30 and the evaluation apparatus 40. It should be noted that, in a configuration with a plurality of the performance processing apparatuses 23 and a plurality of the evaluation apparatuses 40 arranged, the data management apparatus 30 executes the following operation between each performance processing apparatus 23 and each evaluation apparatus 40.

<B-1: Operation Between the Performance Processing Apparatus 23 and the Data Management Apparatus 30>

First, when the user executes a predetermined operation through the input unit 234, the performance processing apparatus 23 is connected to the data management apparatus 30 via the communication network 10. When the user executes a predetermined operation through the input unit 234 in this state to select a desired piece of music, the CPU 231 of the performance processing apparatus 23 transmits an original music data request to the data management apparatus 30 (step S10). This original music data request, a command for requesting the data management apparatus 30 for the original music data, includes the specification of the piece of music selected by the user.

Receiving the original music data request, the CPU 301 of the data management apparatus 30 reads the original music data of the music specified in this request from the storage unit 303 and transmits the retrieved original music data to the performance processing apparatus 23 (step S11). The CPU 231 of the performance processing apparatus 23 stores the received original music data into the storage unit 233.

Then, when the user executes a predetermined operation through the input unit 234 to command the start of performing music, the CPU 231 loads the performance processing programs from the storage unit 233 into the RAM 232 and sequentially executes these programs (step S12). When the programs are executed, the performance processing based on the original music data specified by the user is executed. On the other hand, a plurality of users having their different controls 21 turn on the power to the controls 21 and then swing or shake the controls 21 as desired along with the performance presented by the performance processing apparatus 23.

Figure 10:
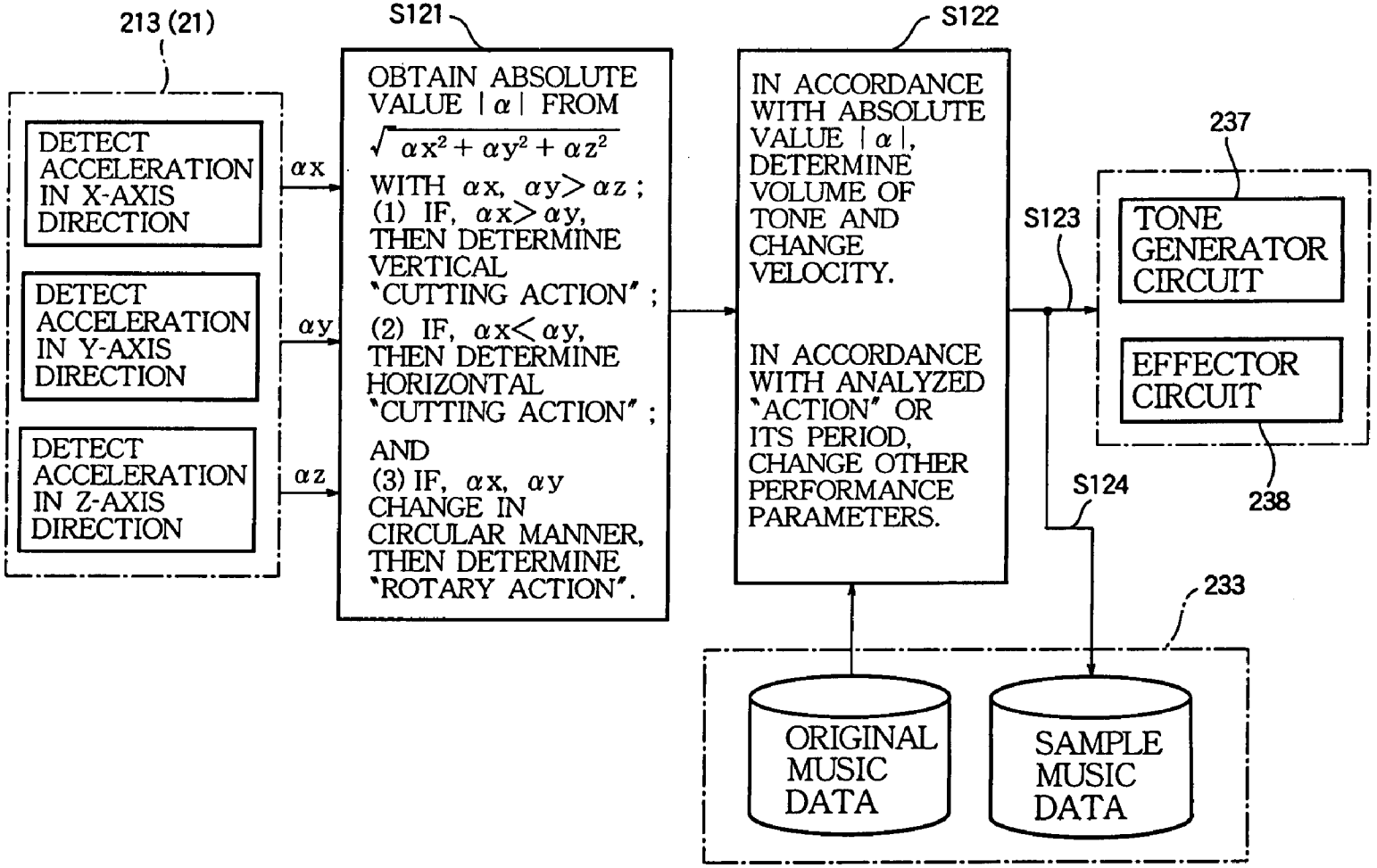
FIG. 10 is a block diagram schematically illustrating the contents of performance processing.

Referring to FIG. 10, there is shown a schematic diagram illustrating the contents of the performance processing (step S12) by the CPU 231. The CPU 231 executes each processing shown in the figure for one or more parts allocated to each control 21. Namely, the CPU 231 identifies the control 21 from which the action information concerned has been received on the basis of the identification information received from the control 21 along with the action information, and executes the processing shown in the figure for the one or more parts allocated to that control 21. In what follows, one or more part data, among all the part data constituting the original music data, are sometimes expressed especially as "target part data."

First, receiving the action information indicative of the accelerations ($\alpha x$, $\alpha y$, and $\alpha z$) of a particular control 21, the CPU 231 analyzes the contents of the action done by the user of this control 21 on the basis of the action information (S121). To be more specific, the CPU 231 first obtains the absolute value $|\alpha|$ of the accelerations applied to the control 21. And, for example, if x-axis acceleration $\alpha x$ and y-axis acceleration $\alpha y$ are greater than z-axis acceleration $\alpha z$ and x-axis acceleration $\alpha x$ is greater than y-axis acceleration $\alpha y$, then the CPU 231 determines that the user is executing "vertical cutting action" in which the user is shaking the control 21 in generally the perpendicular direction; if y-axis acceleration $\alpha y$ is greater than x-axis acceleration $\alpha x$, then the CPU 231 determines that the user is executing "horizontal cutting action" in which the user shaking the control 21 in generally the horizontal direction; and if z-axis acceleration $\alpha z$ is greater than x-axis acceleration $\alpha x$ and y-axis acceleration $\alpha y$, then the CPU 231 determines that the user is executing "pushing action" in which the user is pushing the control 21 forward and backward.

Next, on the basis of the analysis result in step S121, the CPU 231 changes the performance parameters for the target part data read from the storage unit 233 (step S122). Further, the CPU 231 tells the tone with the performance parameter changed to the tone generator circuit 237 or the effector circuit 238 (step S123) and stores the part data indicative of the music after parameter change into the storage unit 233 as one portion of the sample music data (step S124). The following describes the performance parameter change processing in step S122 by use of a specific example.

First, in accordance with the absolute value $|\alpha|$ of the acceleration obtained in step S121, the CPU 231 changes the velocity (namely, the volume of this part) of the event included in the note-on event of the target part data. For example, as the absolute value $|\alpha|$ of the acceleration increases, the CPU 231 increases the velocity and, as the absolute value $|\alpha|$ of the acceleration decrease, the CPU 231 decreases the velocity. If the CPU 231 determines that the user is executing "horizontal cutting action" with the control 21, the CPU 231 changes the delta time (namely, the tempo of this part) of the target part data in accordance with the period of this action. For example, as the period of "horizontal cutting action" increases, the CPU 231 increases the delta time in order to lower the tempo and, as the period decreases, the CPU 231 decreases the delta time in order to quicken the tempo. If the CPU 231 determines that the user is executing "vertical cutting action" with the control 21, the CPU 231 changes the note number (namely, the pitch of the part) of the note-on event included in the target part data in accordance with the period of this action. For example, as the period of "vertical cutting action" increases, the CPU 231 changes the note number to a greater one (a higher pitch) and, as this period decreases, the CPU 231 changes the note number to a smaller one.

As a result of the execution of the processing shown in FIG. 10 for all parts constituting the music piece, a tone represented in accordance with the performance parameter of the original music data and changed in accordance with action of the user is outputted from the loudspeaker 252. At the same time, the sample music data made up of the part data with the performance parameters of the original music data changed in accordance with the user's action are created and stored in the storage unit 233. Subsequently, the user of the performance processing apparatus 23 operates the input unit 234 to enter the names of the users having these controls 21 and the name of the group to which these users belong. The data indicative of these items (hereafter referred to as "user data") are stored in the storage unit 233 as related with the sample music data.

On the other hand, triggered by the predetermined operation done by the user through the input unit 234, the CPU 231 of the performance processing apparatus 23 transmits the sample music data and the user data related thereto from the storage unit 233 to the data management apparatus 30 (step S13 in FIG. 9). Receiving these data, the CPU 301 of the data management apparatus 30 stores the sample music data into the storage unit 303 and updates or newly creates records of the performance contents table on the basis of the user data (step S14).

<B-2: Operation Between the Data Management Apparatus 30 and the Evaluation Apparatus 40>

The following describes the operation with attention paid to the data transfer between the data management apparatus 30 and the evaluation apparatus 40.

First, when the user executes a predetermined operation through the input unit 404, the evaluation apparatus 40 is connected to the data management apparatus 30. When the user selects a target of evaluation in this state, the CPU 401 of the evaluation apparatus 40 transmits a sample music data request to the data management apparatus 30 (step S20). This sample music data request, a command for requesting the data management apparatus 30 for the sample music data, includes the user specification selected by the evaluator.

Receiving the sample music data request, the CPU 301 of the data management apparatus 30 references the performance contents table stored in the storage unit 303 to identify one or more sample music data generated by the group to which the user specified in this request belongs. Then, the CPU 301 reads the identified sample music data along with the original music data common in music piece from the storage unit 303, and transmits these data to the evaluation apparatus 40 (step S21). These sample music data and the original music data are received by the CPU 401 of the evaluation apparatus 40 and stored in the storage unit 403.

Then, on the basis of the sample music data and the original music data stored in the storage unit 403, the CPU 401 of the evaluation apparatus 40 executes processing for providing the evaluator with the data for evaluating the action-associated functions of the user (step S22). To be more specific, the CPU 401 displays the change in the performance parameters from the start to the end of music performance based on the sample music data and the original music data onto the display unit 406 in a graphic manner or outputs the tones based on the sample music data from the loudspeaker 410.

(1) Graphic Representation of Performance Parameters

Figure 11:
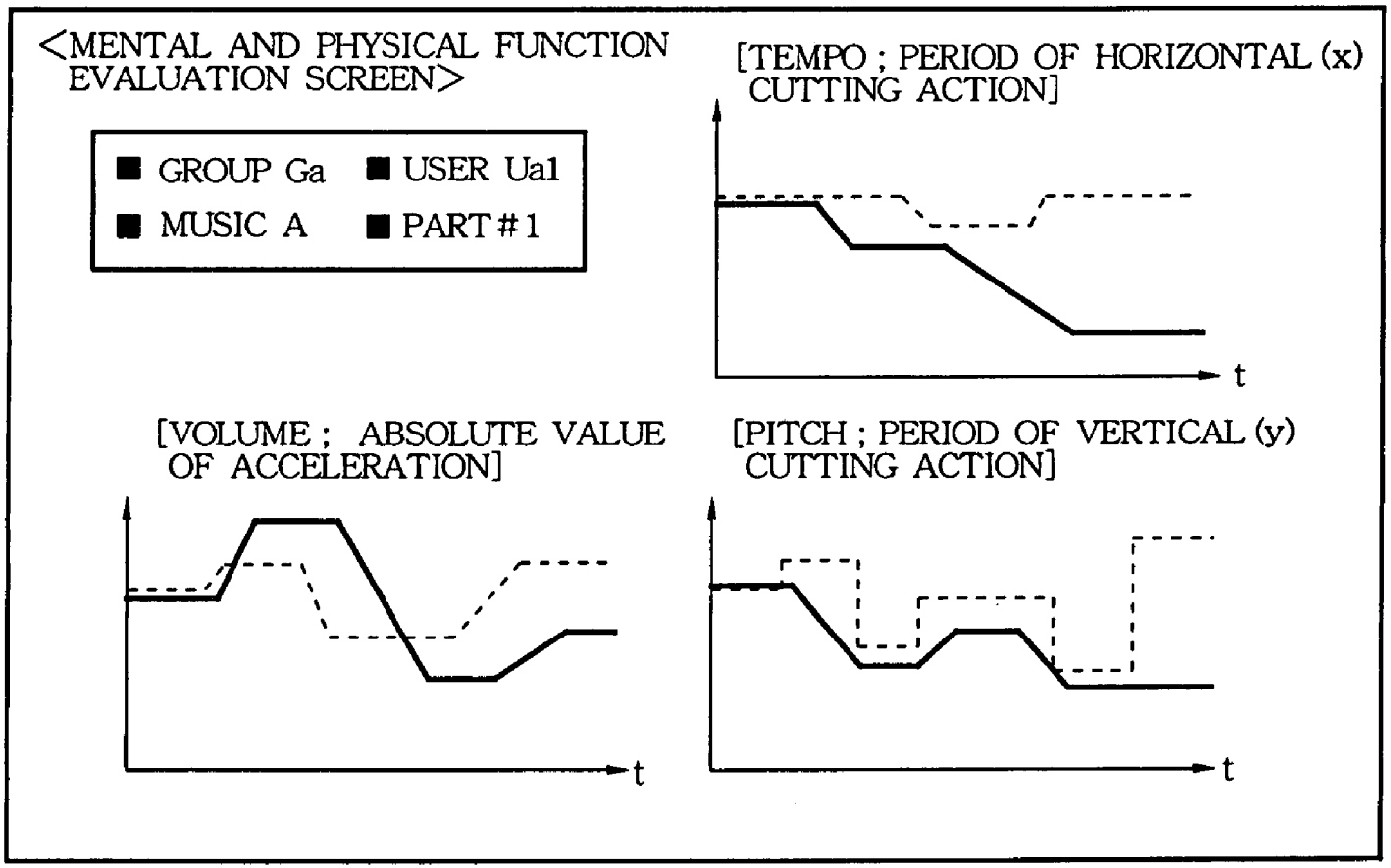
FIG. 11 is a diagram illustrating the contents of a mental and physical function evaluation screen.

When the evaluator executes a predetermined operation through the input unit 404 to command the graphic representation of the performance parameters, the CPU 401 displays a mental and physical function evaluation screen shown in FIG. 11 onto the display unit 406. This screen is provided for each of the users in a group who executed performance by use of the performance processing apparatus 23. FIG. 11 illustrates a mental and physical function evaluation screen prepared for "User Ua1" belonging to "Group Ga". In this example, it is assumed that only one piece of sample music data is obtained for the user to be evaluated, namely the user's performance made by use of the performance processing apparatus 23 was executed only once in the past.

This mental and physical function evaluation screen includes graphs indicative of the performance parameters (tempo, volume, and pitch in this example) associated with a part performed by the user, among the sample music data and the original music data. To be more specific, in the graphs indicative of tempo, volume, and pitch, the changes in the tempo, volume, and pitch of the original music data are represented each with a dashed line, while the changes in the tempo, volume, and pitch of the sample music data are represented each with a solid line.

Referencing this graph representation, the evaluator evaluates the mental and physical functions of the user. For example, the tempo graph shown in FIG. 11 shows that, while there is found an approximate match between the tempo of the original music data and the tempo of the sample music data immediately after the start of the performance of music, the difference therebetween increases as the performance of music progresses. As described above, the tempo of the sample music data is determined in accordance with the period of "horizontal cutting action," so that the evaluator may evaluate that the user (User Ua1) in this graph representation is not enough in the recovery of the horizontal movement function and endurance. Conversely, if there is found an approximate match between the tempo of the original music data and the tempo of the sample music data all over a time from the start to the end of the performance of music, the evaluator may evaluate that the user is fully recovered in the horizontal movement function and endurance. As for the volume determined in accordance with the absolute value of acceleration $|\alpha|$ and the pitch determined in accordance with "vertical cutting action," the evaluator may evaluate the user's mental and physical functions in the same manner as above.

Figure 12:
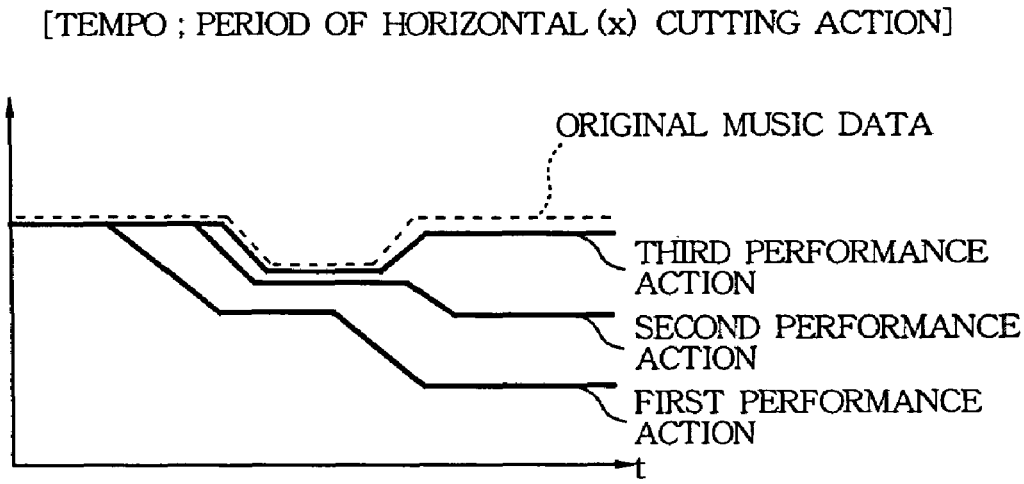
FIG. 12 is another diagram illustrating other contents of the mental and physical function evaluation screen.

On the other hand, if a plurality of pieces of sample music data are received from the data management apparatus 30 for the user to be evaluated, namely, if this user executed several performance actions for the same piece of music by use of the performance processing apparatus 23, a graph shown in FIG. 12 is displayed. It should be noted that FIG. 12 displays only the graph of the tempo; actually, the graphs for the plurality of performance parameters as shown in FIG. 11 are displayed.

The graph in FIG. 12 shows the change in the tempo of the original music data and the tempo change for each of the plurality of sessions of the sample music data. By referencing this graph display, the evaluator may not only evaluate the mental and physical functions based on one performance session, but also evaluate the transition of the time-dependent mental and physical functions based on two or more performance sessions. To be more specific, as shown in FIG. 12, at the first performance session, the deviation in tempo increases in the early stage of music performance, but, as the music performance advances from the second session to the third session, the deviation in tempo decreases. By referencing this graph display, the evaluator may evaluate that the mental and physical functions for carrying out "horizontal cutting action" for the tempo are gradually recovering.

(2) Outputting Tones

When the evaluator executes a predetermined operation through the input unit to command the outputting of tones on the basis of the sample music data (if there are two or more pieces of the sample music data, any one of them), the CPU 401 sequentially outputs the events of the sample music data stored in the storage unit 403 to the tone generator circuit 407 or the effector circuit 408 in a specified timed relation. As a result, the tone indicated by the sample music data is outputted from the loudspeaker 410. Listening to this tone, the evaluator determines whether the tempo, volume, and pitch of the tone sounds natural as compared with the music indicated by the original music data. If there is any unnatural performance parameter, the evaluator evaluates that the user is deficit of the function for performing the action corresponding to the unnatural performance parameter. For example, if the tempo of the music sounded from the loudspeaker 410 gradually delays as the music progresses, the evaluator evaluates that the user lacks the function for "horizontal cutting action" corresponding to the tempo.

When the evaluator executes a predetermined operation through the input unit 404 after the evaluation as above, the CPU 401 of the evaluation apparatus 40 executes the processing for editing the original music data (step S23 in FIG. 9). In this editing processing, the music data to be used by the user for performance actions are generated by changing any of the performance parameters of the original music data on the basis of the results of the evaluation of user's mental and physical functions. For example, for the user determined to be not enough in the function for carrying out "horizontal cutting action" corresponding to the tempo, the evaluator may newly generate the music data in which a tempo slower than that of the original music data is set. The new music data may be generated by displaying the performance parameters of the original music data onto he display unit 406 and editing the contents (or values) of each performance parameter in accordance with the operation done through the input unit 404.

After generating the new music data as described above, the evaluator executes a predetermined operation through the input unit 404 to command the evaluation apparatus 40 for transmitting the newly generated music data to the data management apparatus 30. Detecting this operation, the CPU 401 transmits the newly generated music data to the data management apparatus 30 (step S24). The newly generated music data are received by the CPU 301 of the data management apparatus 30 and stored in the storage unit 303 as the new original music data (step S25). Then, when the original music data are requested by the already evaluated group, the original music data stored in step S25, namely the original music data edited by the evaluator, are transmitted to the performance processing apparatus 23 (step S10).

As described, in the present embodiment, the sample music data with the performance parameters of the original music data altered in accordance with the action done by the user are generated, so that the sample music data thus generated may be used as the quantitative data for evaluating the mental and physical functions of the user. Therefore, the objectivity of the evaluation associated with the mental and physical functions of the user may be enhanced.

If a facility dedicated to the gathering of physiological data such as muscle strength, respiratory rate, and electroencephalography, the user becomes aware of being diagnosed or rehabilitated for mental and physical functions, thereby sometimes increasing his mental bourdon for the worse. However, according to the present embodiment, the sample music data are generated by user's enjoyment of performance actions, so that the data for evaluating user's mental and physical functions may be obtained in an objective manner without making the user aware of being diagnosed or rehabilitated for his mental and physical functions.

Moreover, in the present embodiment, the sample music data having the contents reflecting the user's actions are transmitted to the evaluation apparatus 40, so that there is no need for both the evaluator and the user to have a face-to-face interaction in carrying out the evaluation of mental and physical functions. Namely, the evaluator need not actually visit the user or vice versa. Consequently, the present embodiment mitigates the work loads of both the evaluator and the user and therefore increases the opportunity for the user to be evaluated for his mental and physical functions. For example, the user geographically remote from the evaluator may get the evaluation of mental and physical functions.

<C: Variations>

While the preferred embodiment of the present invention has been described using specific terms, such description is for illustrative purposes only, and it is to be understood that changes and variations may be made without departing from the spirit or scope of the appended claims. For example, the following variations are possible.

<C-1: Variation 1>

In the above-mentioned embodiment, in order for the evaluator to evaluate the mental and physical functions of the user, the change in performance parameters is displayed in graphs on the basis of the original music data and the sample music data and tones are generated on the basis of the sample music data. The method of providing the sample music data and the original music data for the evaluation by the evaluator is not restricted to the above-mentioned embodiment. For example, the integrated values of the differences between the performance parameters of the sample music data and the performance parameters of the original music data or the deviations therebetween may be displayed as numeric values. Namely, "provision of the sample music data (or the sample music data and the original music data) for the evaluation of the mental and physical functions of the user" denotes "outputting of the sample music data to the evaluator such that the evaluator referencing the performance parameters of the sample music data may evaluate the mental and physical functions of the user."

In the above-mentioned embodiment, both the sample music data and the original music data are provided for the evaluation of mental and physical functions. Alternatively, only the sample music data alone may be provided for the evaluation of mental and physical functions. Namely, the original music data common in music with the sample music data are not always required for the evaluation of user's mental and physical functions. For example, if displaying the change in performance parameters of the sample music data or outputting a tone from the loudspeaker 410 on the basis of the sample music data result in a slower tempo halfway in the music, it may indicate that the user's function corresponding to the tempo is not fully operating without requiring to draw a comparison with the performance parameters of the original music data.

However, in order to obtain a more objective and reliable evaluation of user's mental and physical functions, it is preferable to draw a comparison between the performance parameters of the original music data and those of the sample music data. From this point of view, not only the sample music data but also the original music data that are common in music with the sample music data are preferably transmitted to the evaluation apparatus 40 to be provided for the evaluation of mental and physical functions based on the comparison between the performance parameters of both the music data.

<C-2: Variation 2>

In the above-mentioned embodiment and the variation thereto, the sample music data are generated by reflecting the action of the user onto the tempo, volume, and pitch of music. The performance parameters (namely, the elements on which the evaluation of user's mental and physical functions is based) to which the action of the user is to be reflected are not always these three at a time. For example, the action of the user may be reflected to at least one of tempo, volume, and pitch. Alternatively, the action of the user may be reflected to the degree of an effect to be imparted to a tone (for example, the depth of reverberation), a timbre, or other performance parameters. Namely, the performance parameters to be reflected to the contents of the sample music data herein may be any that is quantitatively indicative of user's mental and physical functions.

<C-3: Variation 3>

In the above-mentioned embodiment and the variations thereto, the control 21 which is manually held by the user is used. The form of the control 21 is not necessarily restricted to this type. For example, a control in which the sensor 213 is installed at the heel of a shoe worn by the user may be used as the control 21. In this configuration, the performance parameters are controlled in accordance with the action information obtained when the user treads or tap-dances.

In the above-mentioned embodiment and the variations thereto, the performance parameters are controlled in accordance with the contents of user's action. Instead of this or with the contents of user's action, the performance parameters may be controlled in accordance with the physiological conditions of the user. For example, a pulsation (or pulse wave) detector may be arranged on the control 21 which is wearable on the user to control the performance parameters on the basis of the action information representative of the detection result of pulsation. For the physiological conditions of the user available for performance parameter control, such indexes as body temperature, blood pressure, electroencephalography, respiratory rate, and ocular movement may be mentioned, in addition to pulsation.

As described, the element for determining the performance parameters of the sample music data may be at least one of (or both of) the user's action and the user's physiological condition. The "mental and physical functions" to be evaluated on the basis of the sample music data are a concept which includes such action-associated functions of the autonomic nerve system as the adjustment of body temperature and blood pressure, in addition to the physical action-associated functions for moving arms, legs and other body parts and the mental action-associated functions.

<C-4: Variation 4>

In the above-mentioned embodiment and the variations thereto, the performance processing apparatus 23 carries out the performance processing by use of the original music data supplied by the data management apparatus 30. Alternatively, the original music data for use in the performance processing may be one stored in the storage unit 233 of the performance processing apparatus 23 in advance. For example, the original music data retrieved from portable recording media such as a flexible disk and a CD-ROM (Compact Disk Read Only Memory) may be used for the performance processing by the performance processing apparatus 23.

<C-5: Variation 5>

In the above-mentioned embodiment and the variations thereto, the performance processing system 20 has a plurality of controls 21. Alternatively, the performance processing system 20 may have only one control 21 in which the action of only one user is reflected onto the sample music data.

However, if a plurality of controls 21 are used as with the above-mentioned embodiment, the data for evaluating the mental and physical functions of a plurality of users may be obtained by a single performance processing operation, thereby making the above-mentioned embodiment advantageous in the accumulation of the data with higher efficiency.

<C-6: Variation 6>

In the above-mentioned embodiment and the variations thereto, the data management apparatus 30 and the evaluation apparatus 40 are arranged in a separate manner. It will be apparent that the evaluation apparatus 40 may be functionally arranged in the data management apparatus 30 (or vice versa). Namely, the data management apparatus 30 may have both the function (1) for storing the sample music data supplied from the performance processing system 20 as the data to be provided for the evaluation of user's mental and physical functions and the function (2) for providing the sample music data for the evaluation of user's mental and physical functions on the basis of the performance parameters of the sample music data. This configuration requires the arrangement of a display unit or a tone output unit (namely, a loudspeaker) for providing the sample music data for the evaluation of user's mental and physical functions on the data management apparatus 30. It will also be apparent that the data management apparatus 30 may also carry out the processing of generating the original music data by the evaluator.

<C-7: Variation 7>

A display unit for displaying particular images when the user executes a performance action may be arranged on the performance processing apparatus shown in the above-mentioned embodiment and the variations thereto. The images to be displayed on this display unit may include prepared images and the image of the user himself who is carrying out a performance action, for example. The images to be displayed on this display unit may be appropriately changed in accordance with the actions and physiological conditions of the user. The configuration allows the user to further enjoy his performance actions, thereby making him less aware of being diagnosed or rehabilitated for the more objective evaluation of his mental and physical functions.

<C-8: Variation 8>

In the above-mentioned embodiment and the variations thereto, the data are transferred between the performance processing apparatus 23, the data management apparatus 30, and the evaluation apparatus 40 via the communication network 10. The method the data transfer between these apparatuses is not restricted to the above-mentioned configuration. For example, the data management apparatus 30 may receive the sample music data directly from performance processing apparatus 23 (namely, without using any intervening relay apparatus). This holds true with the data transfer between the data management apparatus 30 and the evaluation apparatus 40. The communication between these apparatuses may be carried out in not only a wired manner, but also in a wireless manner.

As described and according to the invention, the quantitative data for evaluating user's mental and physical functions may be gathered and provided for this evaluation.

The entire content of Priority Document No. 2002-250727 is incorporated herein by reference.

What is claimed is:

1. A performance processing apparatus operable by a user with the aid of a control device and a sound device for providing sample music data to a data management apparatus, the performance processing apparatus comprising:

a first storage section that stores original music data representing a music piece composed of tones;

an acquisition section and acquires input information from the control device which has a detector for detecting either of physical action or physiological state of the user and which is operated by the user to provide the input information indicating the detection result by the detector;

a processing section that controls a performance parameter of the original music data according to the input information, and that generates the sample music data for enabling the sound device to generate tones of the music piece which is represented by the original music data and which is altered by the user; and a transmitting section that transmits the sample music data representing the music piece composed of the tones controlled by the performance parameter and generated by the processing section to the data management apparatus which has a second storage section for storing the sample music data for use as a material of in evaluating the physiological or physical condition of the user by comparing the sample music data with the original music data;

wherein the first storage section stores the original music data divided into part data corresponding to a plurality of parts of the music piece, the acquisition section acquires the input information from a plurality of the control devices which are allotted to one or more of the parts and which are operated by users to jointly perform the allotted parts, the processing section controls the respective performance parameters of the respective parts according to the input information for enabling the sound device to generate tones of the respective parts, and the transmitting section transmits the sample music data to the data management apparatus, the music data containing the part data representing the performance parameters of the respective parts controlled according to the input information.

2. The performance processing apparatus according to claim 1, wherein the data management apparatus initially stores the original music data in the second storage section, the performance processing apparatus further comprising a receiving section that receives the original music data from the data management apparatus.

3. The performance processing apparatus according the claim 1, wherein the processing section controls the performance parameter selected from a volume, tempo, timbre, effect and pitch of the tones.

4. A data management apparatus provided for managing data including original music data and sample music data in association with a performance processing apparatus having a sound device and being operated by a user, the data management apparatus comprising:

a receiving section that receives the sample music data from the performance processing apparatus, which controls a performance parameter of the original music data according to input information representing physical action or physiological state of the user for enabling the sound device to generate tones of a music piece which is represented by the original music data and which is altered by the user, and which generates and transmits the sample music data representing the music piece composed of the tones controlled by the performance parameter;

a storage section that stores the received sample music data generated by the performance processing apparatus for use as in evaluating the physiological or physical function of the user by comparing the sample music data with the original music data; and a transmitting section that transmits the sample music data to an evaluation apparatus which evaluates the physical function of the user according to the performance parameter contained in the transmitted sample music data;

wherein the receiving section receives from the evaluation apparatus music data which contains a performance parameter determined by the evaluation apparatus based on results of evaluating the physiological or physical functions of the user, the storage section stores the music data received from the evaluation apparatus as original music data, and the transmitting section transmits the original music data stored in the storage section to the performance processing apparatus.

5. A data management apparatus provided for managing data including original music data and sample music data in association with a performance processing apparatus having a sound device and being operated by a user, the data management apparatus comprising:

a receiving section that receives the sample music data from the performance processing apparatus, which controls a performance parameter of the original music data according to input information representing physical action or physiological state of the user for enabling the sound device to generate tones of a music piece which is represented by the original music data and which is altered by the user, and which generates and transmits the sample music data representing the music piece composed of the tones controlled by the performance parameter; and a storage section that stores the received sample music data generated by the performance processing apparatus for use as in evaluating the physiological or physical function of the user by comparing the sample music data with the original music data;

further comprising a creating section that creates music data containing a performance parameter determined according to results of evaluating the physiological or physical function of the user, such that the created music data is stored in the storage section as original music data.

6. The data management apparatus according to claim 4 or 5, further comprising another storage section that stores the original music data, and a transmitting section that transmits the stored original music data to the performance processing apparatus.

7. The data management apparatus according to claim 4 or 5, wherein the transmitting section further transmits the original music data representing the same music piece as represented by the sample music data to the evaluation apparatus which evaluates the physiological or physical function of the user by comparing the altered performance parameter contained in the sample music data with an original performance parameter contained in the original music data.

8. The data management apparatus according to claim 4 or 5, further comprising a providing section that provides the sample music data to an evaluator who evaluates the physiological or physical function of the user according to the performance parameter contained in the provided sample music data.

9. The data management apparatus according to claim 8, wherein the providing section provides the original music data representing the same music piece as represented by the sample music data to the evaluator so that the evaluator evaluates the physiological or physical function of the user by comparing the altered performance parameter contained in the sample music data with an original performance parameter contained in the original music data.

10. The data management apparatus according the claim 8, wherein the providing section displays a variation of the performance parameter contained in the sample music data on a display device.

11. The data management apparatus according to claim 8, wherein the providing section generates the tones of the music piece through a sound device according to the sample music data.

12. An evaluation apparatus provided in association with a data management apparatus for evaluating sample music data from a performance processing apparatus having a sound device and being operated by a user, the evaluation apparatus comprising:

a receiving section that receives the sample music data via the data management apparatus from the performance processing apparatus, which controls a music performance parameter of the original music data according to input information representing physical action or physiological state of the user for enabling the sound device to generate tones of a music piece which is represented by original music data and which is altered by the user, and which generates and transmits the sample music data representing the music piece composed of the tones controlled by the performance parameter;

a storage section that stores the sample music data generated by the performance processing apparatus and received by the receiving section; and a providing section that provides the sample music data to an evaluator who evaluates the physiological or physical condition of the user by comparing the sample music data with the original music data according to the music performance parameter contained in the provided sample music data;

further comprising a creating section that creates music data containing a performance parameter determined according to results of evaluating the physiological or physical function of the user, and a transmitting section that transmits the created music data to the data management apparatus which stores the created music data in a storage section as original music data.

13. The evaluation apparatus according to claim 12, wherein the receiving section receives from the data management apparatus the original music data representing the same music piece as represented by the sample music data, and the providing section provides the original music data to the evaluator together with the sample music data so that the evaluator evaluates the physiological or physical function of the user by comparing the altered performance parameter contained in the sample music data with an original performance parameter contained in the original music data).

14. The evaluation apparatus according to claim 12, wherein the providing section displays a variation of the performance parameter contained in the sample music data on a display device.

15. The evaluation apparatus according to claim 12, further comprising a creating section that creates music data containing a performance parameter determined according to results of evaluating the physiological or physical function of the user, and a transmitting section that transmits the created music data to the data management apparatus which stores the created music data in a storage section as original music data.

16. A computer-readable medium encoded with a computer program for use in a performance processing apparatus operable by a user with the aid of a control device and a sound device for providing sample music data to a data management apparatus, the computer program being executable for causing the performance processing apparatus to carry out a method comprising the steps of:

storing in a first storage section original music data representing a music piece composed of tones;

acquiring by an acquisition section input information from the control device which has a detector for detecting either of physical action or physiological state of the user and which is operated by the user to provide the input information indicating the detection result by the detector;

controlling by a processing section a performance parameter of the original music data according to the input information, and generating the sample music data for enabling the sound device to generate tones of the music piece which is represented by the original music data and which is altered by the user; and transmitting by a transmitting section the sample music data representing the music piece composed of the tones controlled by the performance parameter and generated by the processing section to the data management apparatus which has a second storage section for storing the sample music data for use as a material of in evaluating the physiological or physical condition of the user by comparing the sample music data with the original music data;

wherein the first storage section stores the original music data divided into part data corresponding to a plurality of parts of the music piece, the acquisition section acquires the input information from a plurality of the control devices which are allotted to one or more of the parts and which are operated by users to jointly perform the allotted parts, the processing section controls the respective performance parameters of the respective parts according to the input information for enabling the sound device to generate tones of the respective parts, and the transmitting section transmits the sample music data to the data management apparatus, the music data containing the part data representing the performance parameters of the respective parts controlled according to the input information.

17. A computer-readable medium encoded with a computer program for use in a data management apparatus for managing data including original music data and sample music data in association with a performance processing apparatus having a sound device and being operated by a user, the computer program being executable for causing the data management apparatus to carry out a method comprising the steps of:

receiving by a receiving section that receives the sample music data from the performance processing apparatus, which controls a performance parameter of the original music data according to input information representing physical action or physiological state of the user for enabling the sound device to generate tones of a music piece which is represented by the original music data and which is altered by the user, and which generates and transmits the sample music data representing the music piece composed of the tones controlled by the performance parameter;

storing in a storage section that stores the received sample music data generated by the performance processing apparatus for use as in evaluating the physiological or physical function of the user by comparing the sample music data with the original music data; and transmitting by a transmitting section that transmits the sample music data to an evaluation apparatus which evaluates the physical function of the user according to the performance parameter contained in the transmitted sample music data;

wherein the receiving section receives from the evaluation apparatus music data which contains a performance parameter determined by the evaluation apparatus based on results of evaluating the physiological or physical functions of the user, the storage section stores the music data received from the evaluation apparatus as original music data, and the transmitting section transmits the original music data stored in the storage section to the performance processing apparatus.

18. A computer-readable medium encoded with a computer program for use in a data management apparatus for managing data including original music data and sample music data in association with a performance processing apparatus having a sound device and being operated by a user, the computer program being executable for causing the data management apparatus to carry out a method comprising the steps of:

receiving by a receiving section that receives the sample music data from the performance processing apparatus, which controls a performance parameter of the original music data according to input information representing physical action or physiological state of the user for enabling the sound device to generate tones of a music piece which is represented by the original music data and which is altered by the user, and which generates and transmits the sample music data representing the music piece composed of the tones controlled by the performance parameter; and storing in a storage section that stores the received sample music data generated by the performance processing apparatus for use as in evaluating the physiological or physical function of the user by comparing the sample music data with the original music data;

creating by a creating section that creates music data containing a performance parameter determined according to results of evaluating the physiological or physical function of the user, such that the created music data is stored in the storage section as original music data.

19. A computer-readable medium encoded with a computer program for use with an evaluation apparatus provided in association with a data management apparatus for evaluating sample music data from a performance processing apparatus having a sound device and being operated by a user, the computer program being executable for causing an evaluation apparatus to carry out a method comprising the steps of:

receiving by a receiving section that receives the sample music data via the data management apparatus from the performance processing apparatus, which controls a music performance parameter of the original music data according to input information representing physical action or physiological state of the user for enabling the sound device to generate tones of a music piece which is represented by original music data and which is altered by the user, and which generates and transmits the sample music data representing the music piece composed of the tones controlled by the performance parameter;

storing in a storage section that stores the sample music data generated by the performance processing apparatus and received by the receiving section; and providing by a providing section that provides the sample music data to an evaluator who evaluates the physiological or physical condition of the user by comparing the sample music data with the original music data according to the music performance parameter contained in the provided sample music data creating by a creating section that creates music data containing a performance parameter determined according to results of evaluating the physiological or physical function of the user, and a transmitting section that transmits the created music data to the data management apparatus which stores the created music data in a storage section as original music data.

* * * * *

UNITED STATES PATENT AND TRADEMARK OFFICE

CERTIFICATE OF CORRECTION

PATENT NO. : 7,297,857 B2
APPLICATION NO. : 10/640590
DATED : November 20, 2007
INVENTOR(S) : Yoshiki Nishitani et al.

It is certified that error appears in the above-identified patent and that said Letters Patent is hereby corrected as shown below:

Title Page, Column 1:

Add --(30) Foreign Application Priority Data - August 29, 2002
(JP) 2002-250727--

Column 16, Line 48, Claim 3:
"the" should be --to--

Column 18, Line 9, Claim 10:
"the" should be --to--

Signed and Sealed this

Twenty-seventh Day of May, 2008

JON W. DUDAS
*Director of the United States Patent and Trademark Office*